United States Patent [19]

Herbruck

[11] Patent Number: 4,491,991

[45] Date of Patent: Jan. 8, 1985

[54] TOILET COVER ATTACHMENT

[76] Inventor: Steven L. Herbruck, 1441 Devonshire Dr., Oxnard, Calif. 93030

[21] Appl. No.: 507,725

[22] Filed: Jun. 27, 1983

[51] Int. Cl.[3] ..... A47K 17/00

[52] U.S. Cl. ..... 4/661; 4/239; 116/67 R

[58] Field of Search ..... 4/661, 493, 483, 449, 4/504, 300, DIG. 3, 239, 234, 235; 116/67 R

[56] References Cited

U.S. PATENT DOCUMENTS

| | | | |
|---|---|---|---|
| 2,075,308 | 3/1937 | Simonsen | 4/239 X |
| 2,361,677 | 10/1944 | Bramhall | 116/67 R |
| 2,535,704 | 12/1950 | Snyder et al. | 116/67 R |
| 2,721,531 | 10/1955 | Findley, Jr. | 116/67 R |
| 2,766,716 | 10/1956 | Mackey | 116/67 R |
| 2,788,764 | 4/1957 | Headlee | 116/67 R |
| 3,020,528 | 2/1962 | Swanson, Jr. et al. | 116/67 R X |

*Primary Examiner*—Henry K. Artis
*Attorney, Agent, or Firm*—Jack C. Munro

[57] ABSTRACT

A toilet seat cover position monitoring device in the form of an attachment to the inside surface of a cover. Upon the cover being moved to the upper position permitting access into the toilet bowl, a first light begins to blink. After a set period of time, a buzzer will begin to sound. Deactivation of both the first light and buzzer will occur upon the toilet seat cover being moved to the lower position covering the opening of the toilet bowl.

10 Claims, 8 Drawing Figures

Fig. 1.
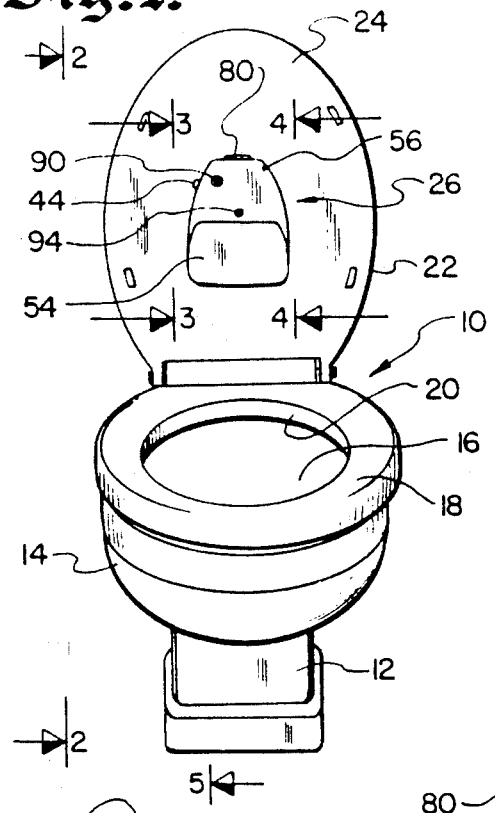
Fig. 2.
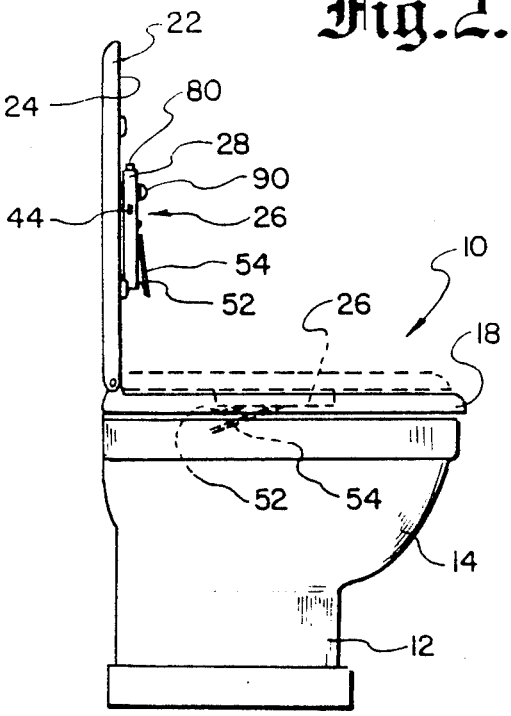
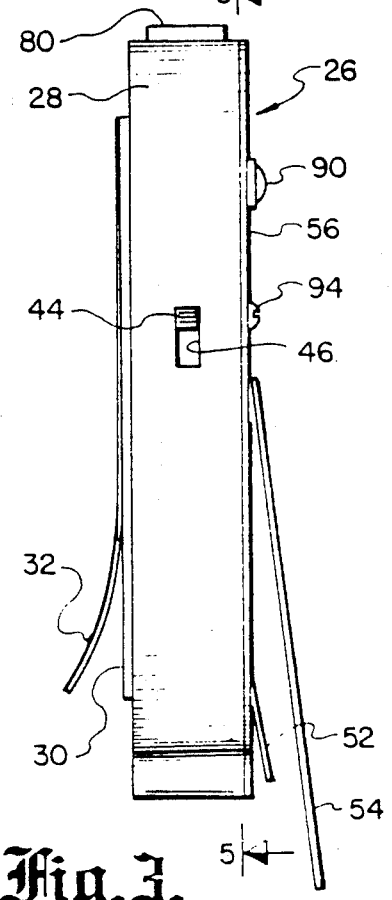
Fig. 3.
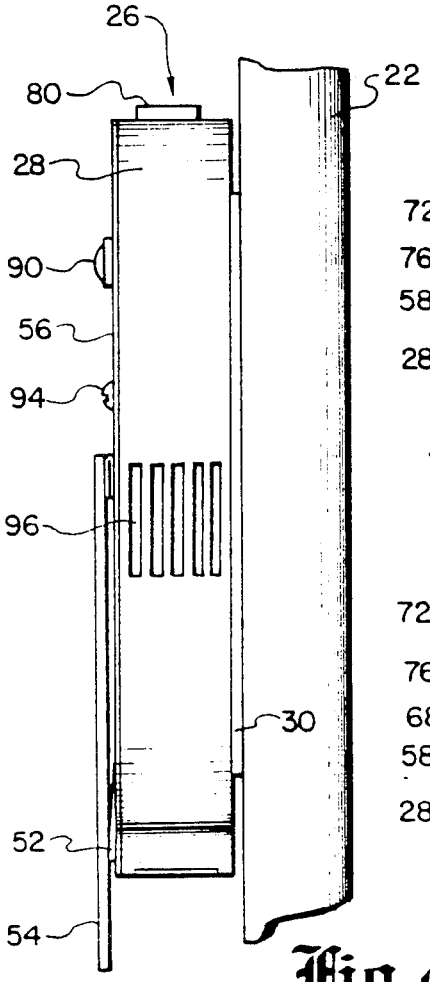
Fig. 4.
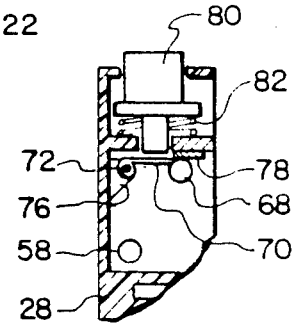
Fig. 6.
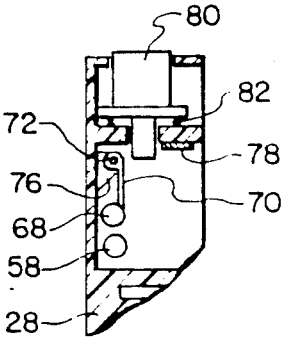
Fig. 7.

TOILET COVER ATTACHMENT

BACKGROUND OF THE INVENTION

The field of this invention relates to toilets and more particularly to attachment to the cover of a toilet seat to assist a human being in ascertaining whether the toilet seat is in the upper position permitting access into the toilet bowl.

The use of toilets to dispose of human waste in residents and buildings has long been known. A common form of toilet includes a water tank which is connected to a toilet bowl. A flushing mechanism is associated with the tank. A seat, upon which the user is to sit, is mounted on the toilet bowl.

It is common to include a separate cover mounted in conjunction with the toilet seat. The cover is to be movable between a lower, horizontal position located across the toilet seat and therefore preventing access into the toilet bowl and to an upper position which is substantially vertical, which permits access into the toilet bowl. For appearance reasons, it is normally preferred that the cover be located on the toilet seat when the toilet is not in use.

Also, it is common for infants to be attracted to toilets, especially after they have learned to walk. The infants have a tendency to "play" in the water located in the toilet bowl, if the toilet seat cover is in the upper position. Normally, this is not preferred for reasons of sanitation. Still further, in certain instances, it has been known for an infant to climb into the toilet bowl and drownings have occurred.

SUMMARY OF THE INVENTION

The primary objective of this invention is to construct an attachment for the toilet seat cover of a toilet which is to make known to any individual located nearby when the toilet seat cover is in the upper position.

Another objective of this invention is to construct an attachment for a toilet seat cover which is small in size and can be readily installed by even the most unskilled individual in a matter of a few seconds to any conventional toilet seat cover.

The attachment of the present invention is confined within a self-contained housing. One side of the housing is to be attached by conventional fastening means, such as double sided adhesive tape, to the inside surface of the toilet seat cover. A first light is mounted within the housing and is connected through an appropriate circuit to a battery mounted within the housing. The first light is to be deactivated when the toilet seat cover is in the lower position and is activated by blinking when the toilet seat cover in the upper position. This means that any individual in close proximity to the toilet can readily observe the blinking light to remind that individual that the toilet seat cover should be moved to the lower position.

Also included within the housing is a sound emitter in the form of a buzzer. Upon the toilet seat cover being located in the upper position for a set period of time, such as thirty seconds, and has not yet been moved to the lower position, the sound emitter will then be activated. Emission of the sound is to note to any individual within "ear shot" that the toilet seat cover remains in the upper position and should be moved to the lower position. Attached to the housing is a deactivatable switch assembly which will be contacted by the back of any user of the toilet seat to deactivate both the light and the buzzer. Also to be included on the housing is a separate light circuit which can be separately activated to illuminate the toilet bowl in a darkened environment, such as at night time. A single battery source is to operate the blinking light, the buzzer and the illuminating light. The housing may also include a separate pocket within which may be located a deodorizer.

BRIEF DESCRIPTION OF THE DRAWINGS

FIG. 1 is a front, elevational view of a typical toilet bowl showing the toilet seat in the lower position and the toilet seat cover in the upper position, with the attachment of the present invention being mounted on the inside surface of the toilet seat cover;

FIG. 2 is a side elevational view of the toilet taken along line 2—2 of FIG. 1;

FIG. 3 is a left side elevational view of the attachment of the present invention as it is shown within FIG. 2 but showing only the attachment enlarged and also with the deactivatable switch assembly in the inoperable position;

FIG. 4 is a right side elevational view of the attachment of the present invention showing the deactivatable switch assembly in the closed (or operable) position;

FIG. 6 is a cross-sectional view through manually operable switch mechanism which operates the illuminating light assembly mounted in conjunction with the attachment of the present invention taken along line 6—6 of FIG. 5 showing the switch assembly in the deactivated position;

FIG. 7 is a view similar to FIG. 6 but showing the switch assembly in the activated position.

DETAILED DESCRIPTION OF THE SHOWN EMBODIMENT

Figure 5:
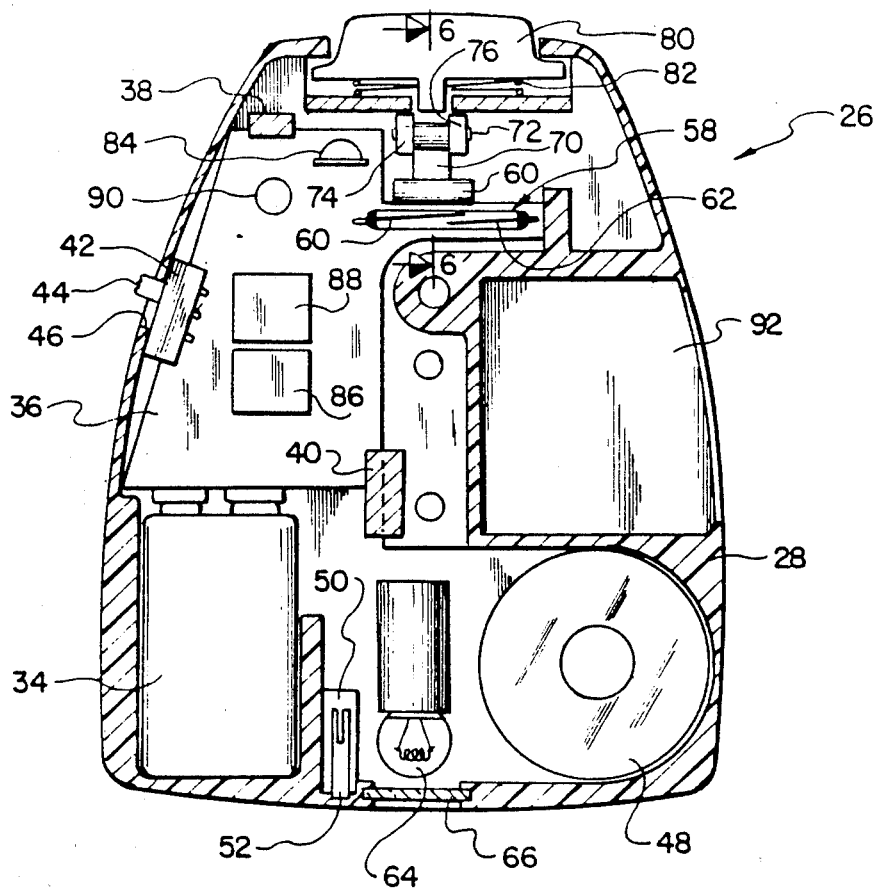
FIG. 5 is a cross-sectional view through the housing of the present invention taken along line 5—5 of FIG. 3.

Referring particularly to the drawings, there is shown in FIGS. 1 and 2, a conventional toilet 10, which has a base 12 which is to be mounted on a supporting surface, such as a floor (not shown) in a building or residence. Integrally attached to the base 12 is a toilet bowl 14. The toilet bowl 14 includes an internal chamber 16 within which human waste is to be deposited.

Attached to the back side of the bowl 14 is a seat 18 which has centrally located internal opening 20 which connects with the internal chamber 16. The seat 18 is pivotable between a lower position shown in FIG. 1 to an upper position located substantially ninety degrees spaced from the lower position. A cover 22 which has an inner surface 24, is also pivotably mounted in respect to the bowl 14. The cover 22 is to be movable between an upper position shown in FIG. 1 to a lower position shown in dotted lines in FIG. 2. The lower position places the cover 22 over the seat 18 covering the opening 20.

The attachment 26 of this invention which defines an exterior sheet material housing 28, is to be attached, as by a strip of adhesive tape 30 mounted on the back side of the housing 28, to the bottom surface 24 of the cover 22. Prior to attachment of the tape 30 to the surface 24, such is protected from unauthorized securement through the use of a cover sheet 32. It is to be understood that the cover sheet 32 will be removed prior to physically locating the attachment 26 at the desired location.

Within the housing 28 there is located a battery 34. The battery 34 connects with a printed circuit board 36. The electrical components of the printed circuit board 36 are deemed to be conventional and forms no specific part of this invention. It is understood that any individual skilled in electronics could design numerous varieties of printed circuit boards 36 that could operate in the desired manner. The printed circuit board 36 is held in place between spaced-apart members 38 and 40 which are integrally connected to the housing 28.

A switch 42, which is manually operated by means of knob 44, is connected to the housing 28, with the knob 44 extending through opening 46 formed within the side wall of the housing 28. The switch 42 is electrically connected to the printed circuit board 36. The function of the switch 42 will be explained further on in the specification.

Also mounted within the housing 28 is a sound emitter in the form of a buzzer 48. The structure of the buzzer 48 is deemed to be conventional and forms no specific part of this invention. The buzzer is also electrically connected to the printed circuit board 36.

Also mounted within the housing 28 is a contact switch. The contact switch 50 includes an inner contact (not shown) and an outer contact 52. The outer contact 52 is to be contractable by plate 54. The plate 54 is hingedly mounted onto front cover 56 of the housing 28. The plate 54 is normally biased to a slightly outwardly extending position, as shown in FIG. 3 of the drawings. The contact 52 extends from an opening formed within the front cover 56. Movement of the plates 54 against the front cover 56 causes the contact 52 to be moved to an inner position as shown in FIG. 4 of the drawings. This results in opening of the switch 50. The switch 50 is normally closed.

Mounted within the housing 28 is a reed switch 58. The reed switch 58 is deemed to be conventional and comprises a glass envelope within which is located a pair of reed-like metal members 60 and 62. The reed switch 62 is connected through the printed circuit board 36 to the light bulb 64. Light bulb 64 is mounted on the housing 28.

The light bulb 64, when activated, is to emitt a light beam through transparent window 66. The window 66 is mounted within the bottom surface of the housing 28.

The reed switch 28 is closed when magnet 68 is located in close proximity thereto. This close proximity is shown in FIG. 7 of the drawings. The magnet 68 is mounted on a mounting arm 70. The mounting arm 70 is pivotally mounted by a pivot pin 72 between a pair of protuberances 74 and 76 which are in turn mounted on the housing 28. The magnet 68 is free to move with respect to the protuberances 74 and 76 except when held against movement by the magnet 68A butting metal plate 78 which is mounted on a portion of the housing 28.

Also mounted on the housing 28 is a button 80. The button 80 connects with the spring 82 which biases the button 82 in an outwardly extending position. Movement of the button 80 to an inward position compressing the spring 82 will cause the inner portion of the button 80 to come into contact with the mounting arm 70 which will cause the magnet 68 to be spaced from the metal plate 78 and then pivot from the position shown in FIG. 6 to the position shown in FIG. 7. With the magnet 68 shown in FIG. 7, it is in close proximity to reed switch 58 which thereby closes the reed switch 58 and thereby activates light 64. It is to be noted that this lighting of the light 64 is only to occur with the cover 22 in the vertical or upper position. Lighting of the light 64 is for the purpose of illuminating the internal chamber 16 of the toilet bowl 14. Upon the cover 22 being moved to the lower or horizontal position, the magnet 68 will automatically be moved by gravity to come into contact with the metal plate 78 and will be held thereto and displaced from the reed switch 58. When displaced from the reed switch 58, contacts 60 and 62 will be separated thereby opening the circuit to the light 64. With the magnet 68 in close proximity to the reed switch 58, it is understood that the contacts 60 and 62 will be drawn together, thereby completing the circuit and lighting of the light 64.

Figure 8:
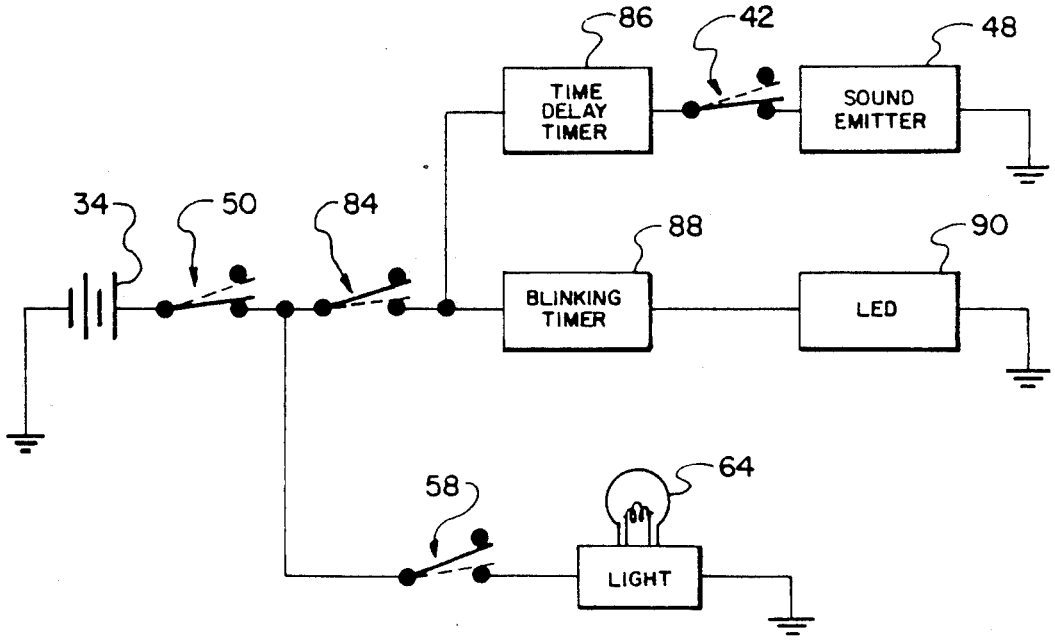
FIG. 8 is an electrical circuit block diagram of the attachment of the present invention.

Connected to the printed circuit board 36 is a mercury switch 84. The structural arrangement of the mercury switch 84 is deemed to be conventional and forms no specific part of this invention. The mercury switch 84 is oriented on the printed circuit board 36 so that with the cover 22 in the lower position, the switch 84 is open, as shown in FIG. 8 of the drawings. Actually, the solid line locations of the switches 42, 50, 58 and 84 within FIG. 8 are the position that these switches will be in when the cover 22 is in the lower position. With the cover 22 in the upper position, the mercury switch 84 will automatically close. Since switch 50 is also closed, this means that electrical energy is now being supplied to both the time delay timer 86 and the blinking timer 88, which are mounted on the printed circuit board 36. After a preset period of time, such as thirty seconds, the time delay timer 86 will cause activation of the sound emitter 48. Immediately upon closure of the switch 84, the blinking timer 88 will cause the light source, usually in the form of a light emitting diode 90 to blink on and off short intervals, such as one half second intervals.

There is an optional feature that will normally be included, a separate compartment 92 formed within the housing 28. Within this second compartment 92, there is to be contained a deodorizing compound (not shown). The deordorizing compound is located within the compartment 92 by removing of screw fastener 94, which permits removal of the entire front cover 56, thereby gaining access into the compartment 92. The compartment 92 is to be exposed to the ambient even with the front cover 56 remounted onto the housing 28 due to the plurality of slotted openings 96 formed to the side wall of the housing 28.

It is to be noted that access into the internal compartment of the housing 28 for the purpose of changing of the battery 34 or the light bulb 64, as well as for maintenance of any of the components contained therein is also by means of removing of the front cover 56.

The actual operation of the attachment 26 of this invention is as follows: Upon moving of the cover 22 from the lower position to the upper position, the mercury switch 84 is closed. Contact switch 50 is normally closed.

However, upon an individual occupying the seat 18, the back of the individual will push against plate 54, which in turn will push against contact 52 and open switch 50. At this particular time, it is not possible to operate either the light emitting diode 90, the sound emitter 48 or the light 64.

However, if the seat 18 is not occupied, it will be possible for the user to manually depress button 80 which in turn will cause movement of the magnet 68 into close proximity with the reed switch 58, which in turn will close such and activate the light bulb 64. Also, since the mercury switch 84 has closed, the timers 86 and 88 are activated. Activation of the timer 88 causes immediate blinking of light 90 to at least make aware to the user of the toilet 10 that the cover 22 is in the upper position.

If the user, after usage of the toilet 10, fails to move the cover 22 to the lower position, within thirty seconds the timer 86 will then cause activation of the sound emitter 48. Normally the switch 42 is closed. The sound emitter 48 should be loud enough so that it will be heard by any person within fifteen to twenty five feet of the toilet 10.

If for any reason it would not be desirable to utilize the sound emitter 48, such can be manually turned off and remain off by manual movement of the knob 44 to move the switch 42 to the open position. Also, if the sound emitter 48 is activated during normal usage of the toilet 10, the user only needs to strike plate 54 to momentarily open the switch 50. This will restart the timer 86 and it will be another thirty seconds before the sound emitter 48 is activated.

What is claimed is:

1. In combination with a toilet, said toilet having a bowl, said toilet having a seat, said toilet having a cover, said cover being pivotable between a lower (horizontal) position and an upper (vertical) position, said lower position preventing access into said bowl, said upper position permitting access into said bowl, a toilet cover attachment comprising:

an annunciator assembly including a first annunciator and a second annunciator, said first annunciator being activated upon said cover being located in said upper position and deactivated upon said cover being located in said lower position; and said second annunciator being time delay activated upon said cover being located in said upper position and deactivated upon said cover being located in said lower position.

2. The combination as defined in claim 1 wherein: said first annunciator comprising a first light.

3. The combination as defined in claim 2 wherein: said first light being connected to a first timer, said first timer causing said first light to blink.

4. The combination as defined in claim 1 wherein: said second annunciator comprising a sound emitter.

5. The combination as defined in claim 1 wherein: both said first annunicator and said second annunciator being mounted within a housing, a source of electrical energy in the form of a battery being mounted within said housing.

6. The combination as defined in claim 5 wherein: a second light assembly being mounted within said housing, said second light assembly being connected to said battery through a manually operable switch, operation of said manually operable switch causes said second light assembly to be activated to facilitate visual observation of said toilet bowl.

7. The combination as defined in claim 6 wherein: said first annunciator comprising a first light.

8. The combination as defined in claim 7 wherein: said first light being connected to a first timer, said first timer causing said first light to blink.

9. The combination as defined in claim 8 wherein: said second annunciator comprising a sound emitter.

10. The combination as defined in claim 9 wherein: said housing including a deactivating switch mechanism, said deactivating switch mechanism being normally contactable by the body of the human being upon the human being assuming a normal usage position of said toilet, said deactivating switch mechanism to deactivate both said first annunciator and said second annunciator.

* * * * *